US006279746B1

(12) United States Patent
Hussaini et al.

(10) Patent No.: US 6,279,746 B1
(45) Date of Patent: Aug. 28, 2001

(54) RECLOSABLE BLISTER PACK

(75) Inventors: Saied Hussaini; Marc Tacovelli, both of Miami, FL (US)

(73) Assignee: Rally Manufacturing, Inc., Miami, FL (US)

( * ) Notice: Subject to any disclaimer, the term of this patent is extended or adjusted under 35 U.S.C. 154(b) by 0 days.

(21) Appl. No.: 09/532,946

(22) Filed: Mar. 22, 2000

(51) Int. Cl.[7] ..... B65D 73/00
(52) U.S. Cl. ..... 206/470; 206/467; 206/461
(58) Field of Search ..... 206/45.23, 461, 206/467, 470

(56) References Cited

U.S. PATENT DOCUMENTS 3,581,885 6/1971 Wald .
3,695,419 * 10/1972 Packert et al. ..... 206/45.34
4,005,776 * 2/1977 Seeley ..... 206/461
4,784,268 11/1988 Perchak .
4,930,627 6/1990 Borst et al. .
5,012,927 * 5/1991 Borst ..... 206/470
5,038,936 * 8/1991 Borst ..... 206/470
5,147,035 9/1992 Hartman .
6,070,723 * 6/2000 Lewis ..... 206/470

* cited by examiner

*Primary Examiner*—David T. Fidei
(74) *Attorney, Agent, or Firm*—Liniak, Berenato, Longacre & White

(57) ABSTRACT

A reclosable blister package wherein the blister package assembly is divided into main body portion and a door portion separated by an integral hinge formed therein. The first or main body portion of the blister package assembly is permanently attached to a planar base backing member, with the second or door portion being attached to the backing at its flanges by a reclosable system including interconnecting members, for example, projections/recesses, a tab and slot, or a "button" and "hole", disposed on the side walls or on an extension flange extending from the flange of the main body.

13 Claims, 7 Drawing Sheets

RECLOSABLE BLISTER PACK

BACKGROUND OF THE INVENTION

1. Field of the Invention

This invention relates to resealable and reclosable packages, and more particularly to a reclosable blister type package for displaying packaged goods in a container which can be opened and resealed without obvious or apparent damage.

2. Description of Related Art

A form of packaging commonly used in retail merchandising is the blister package designed for pegboard display. Generally, these types of packages have a cardboard backing, upon which product or advertising information is printed, and to which is attached a clear plastic blister assembly to form a container in which goods are displayed and held. A hole is formed at the top of the cardboard backing so that the package can be held on an extended peg of a pegboard display. In this manner large volumes of varied items can be held on a pegboard, in stores where shelf space is a premium.

This type of packaging is used for numerous and varied types of items and would includes such things as small quantities of nails, aftermarket automotive products (e.g. windshield wipers and wiper refills), batteries, and other items too numerous to mention. In the usual case, blister packaging is required when it is desirable to provide a convenient way of merchandising preselected number of units, such as a package containing four windshield wipers and/or refills. A second object of the conventional blister pack is to provide security for the goods, because the blister package is substantially bigger than the goods themselves, which makes pilferage and shoplifting much more difficult. An example of this would be a ballpoint pen, which if offered for sale in bulk and contained in a shelf bin, could easily be pilfered merely by picking up and inserting one in a shirt pocket. On the other hand, if held in a blister package, pilferage is a much more difficult and risky task, since the pilferer must break open the package to remove the pilferable contents.

As a result, most of the development work in the past has been directed toward providing blister package which are destroyed when opened. Typically, these blister packaging devices have a cardboard backing to which is attached a clear plastic assembly. An adhesive plastic material is first sprayed onto the surface of the cardboard, usually the entire surface in cases where the blister packaging is of the same relative size as the cardboard backing. Then the cardboard backing is positioned atop the blister pack assembly, together with its contents, and heat is applied to the flanged edges of the blister pack to bond the cardboard, plastic adhesive and blister pack assembly flanges together. This process is called heat sealing.

In order to open the package, the plastic assembly must be torn from the cardboard backing. An improvement in common use today, includes providing perforations in the cardboard backing to facilitate access to the goods through the cardboard.

A problem arises when it is desired to provide blister packaging suitable for pegboard display, wherein the blister back can easily be opened and reclosed/resealed without apparent damage to the packaging itself. This would be of value in situations where it is desirable to remove the goods from the package for inspection prior to purchase, or in cases where intended use of the goods is such that the purchaser will use only a few items at a time and wish to store, in the original packaging, the remaining items. Examples of these situations would be where a prospective purchaser of a set of windshield wipers or other products wherein the purchaser may purchase a plurality of items when only one or two are needed, with the rest to be stored for future use.

The need exists for a reclosable blister package made from one thermoformed plastic blister that can be easily opened and reclosed without damages to the package, which can be affixed to the backing card in a tamper resistant fashion, and which can be secured to the backing card while fully loaded.

SUMMARY OF THE INVENTION

These objects are accomplished by use of a packaging system having a planar base surfaced formed of cardboard or the like, with a heat sealing coating, and a copolyester plastic blister assembly. The plastic blister assembly has a main body portion forming a merchandise compartment and a door portion separated by an integrally formed hinge extending transversely across the blister pack assembly. The integral hinge defines a boundary line between the main body portion and an upper, reclosable, door portion.

A pair of first opposing side walls and an interconnecting end wall extend from the edges of the main body portion to form, when the plastic assembly is attached to the backing plate, a container for the packaged merchandise. An attachment flange circumscribes the end and sidewalls of the lower, first portion, and provides an attachment surface for adhesively attaching the plastic container to the backing plate. The plastic blister assembly is permanently attached to the cardboard planar backing plate by means of a heat sealing process using a nonsealable adhesive between the first attachment flange and the backing plate.

The door portion, in like manner, has extending from its sides and end, second or upper end and side walls, and a circumscribing, second attachment flange, all similar in size and appearance to the first or lower end, end wall, side walls and attachment flange.

An attachment means may be provided between the door portion and the main body portion, for example, in the form of a mating projection/recess, a tab and slot arrangement, or a "button" and "hole" arrangement. Other suitable attachment systems may also be employed; for example, a pair of opposing locking tabs may retain the upper section in a closed position.

With the reclosable system of the invention, a consumer may purchase a plurality of items packaged within a single blister pack, whereby a single item may be removed for use and the remaining item stored in the original pack for later use.

Additional features, benefits and advantages will become apparent from the following detailed description taken in conjunction with the accompanying drawings showing several preferred embodiments of the instant invention.

DETAILED DESCRIPTION OF THE INVENTION

Figure 1:
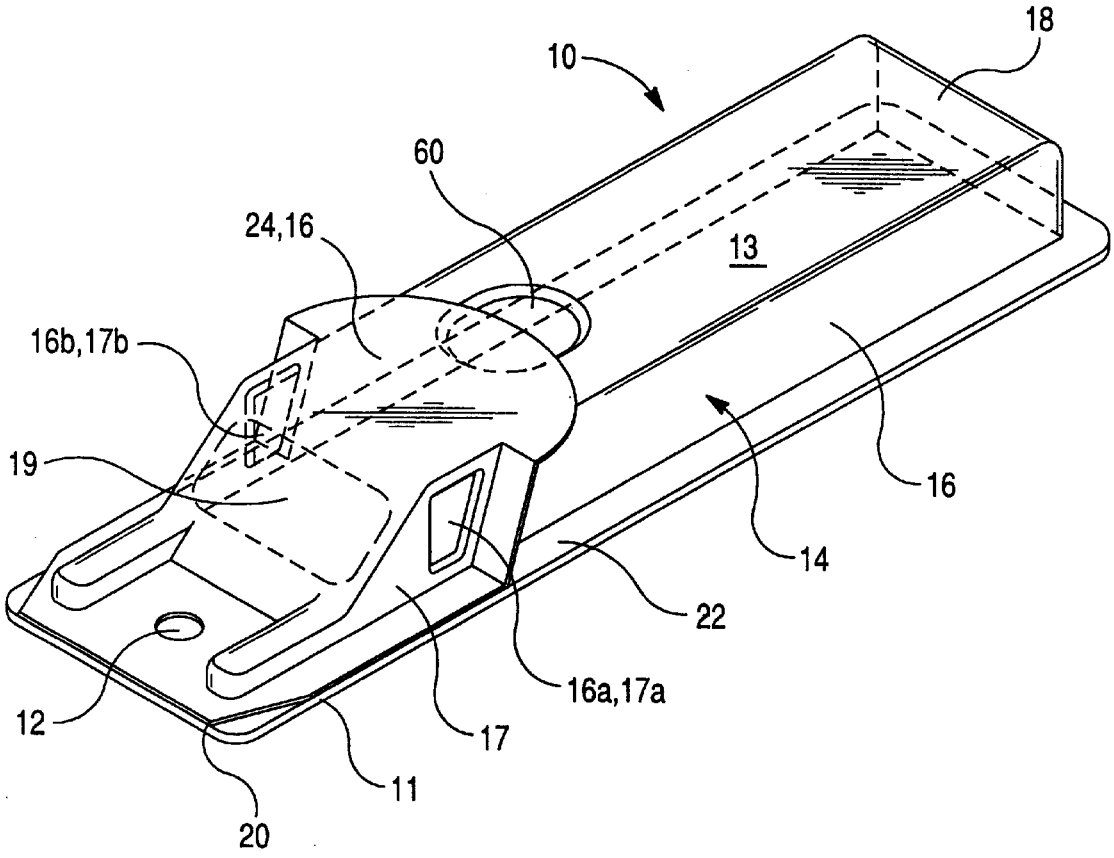
FIG. 1 is a perspective representational view of the embodiment of the reclosable blister package assembly having a pair of opposing locking tabs shown in a closed position.
Figure 2:
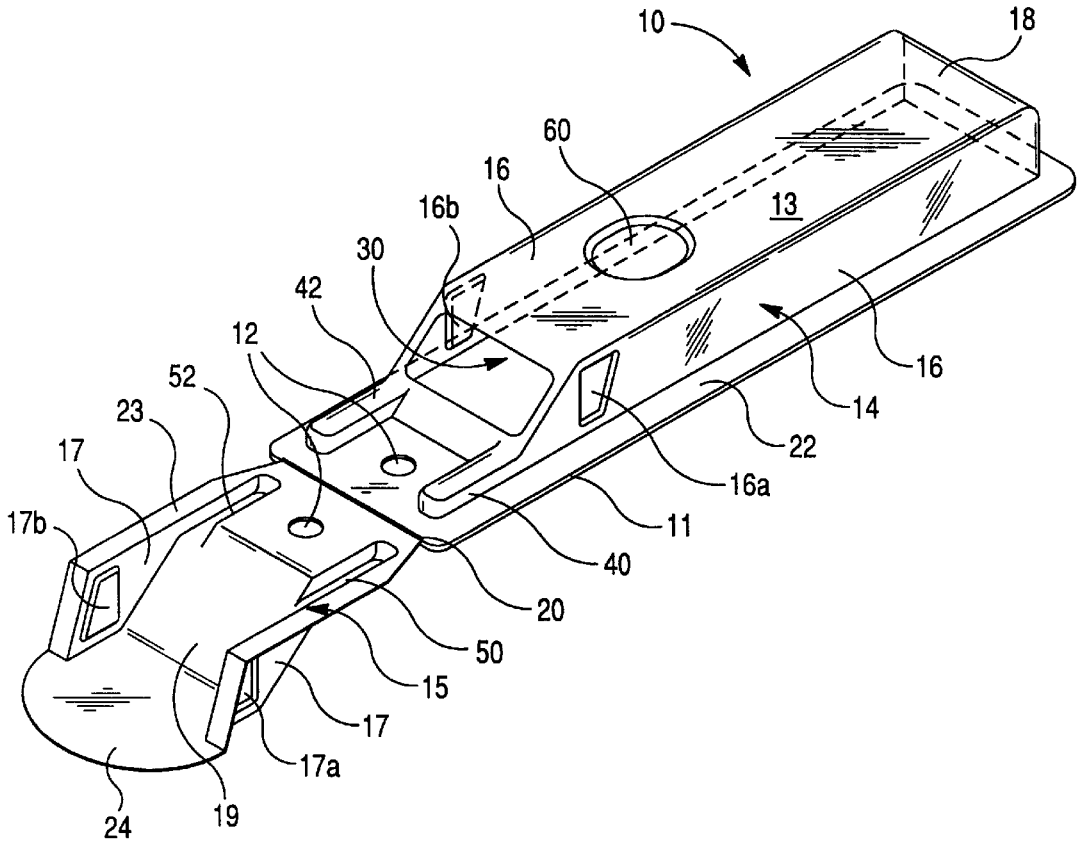
FIG. 2 is a perspective representational view of a tab and slot embodiment of the reclosable blister package assembly of FIG. 1 shown in an opened position.

As shown in FIGS. 1 and 2, a plastic blister package assembly 10 is designed to be hung from a peg hook (not shown) inserted through peg hook hole 12 in assembly 10. A plastic blister assembly 13, formed of unitary construction and preferably of copolyester plastic, typically a glycol modified polyethylene terephthalate, or PVC is provided for attachment to planar backing substrate or plate 11.

Transverse hinge 20 is integrally formed in the plastic assembly 13 and serves as a dividing line between a main body portion 14 and a pivoting door portion 15. Extending from the sides of main body portion 14 are main body portion side walls 16 and an interconnecting first portion end wall 18. Circumscribing sidewalls 16 and end wall 18 is first portion attachment flange 22. Attachment flange 22 is heat sealed to the base plate 11 for permanently attaching plastic assembly 13 to base plate 11. When so attached, a compartment is formed into which merchandise can be inserted through an access opening 30.

In like manner, the door portion 15 has extending from its sides, second portion side walls 17 and interconnecting second portion end wall 19. Circumscribing sidewalls 17 and interconnecting end wall 19 is second portion attachment flange 23.

When the door portion 15 of plastic assembly 13 is in the closed position (see FIG. 1), the blister package assembly 10 appears to be of unitary construction having a single compartment all of which is adhesively attached by means of a circumscribing attachment flange to base plate 11.

By providing the transverse hinge 20, the door portion 15 of plastic assembly 13 can be folded out away from base plate 11 to provide access to the merchandise compartment defined by the lower portion of plastic assembly 13 and base plate 11, even though base plate 11 is without any hinges as is shown in FIG. 1. Access to the merchandise compartment is provided through the access opening 30 formed in the place of the sidewall facing the end wall 18.

In order to provide a reclosable arrangement, the side walls 16 of main body portion 14 comprise depressions 16*a* and the side walls 17 of the door portion 15 comprise corresponding inward projections 17*a*. In the closed position, the projections 17*a* matingly engage the depressions 16*a* to lock the door portion 15 against the main body portion 14 and thereby close the access opening 30. Moreover, because the projections 17*a* and depressions 16*a* are locating in opposing fashion, the resilient nature of the side walls 16, 17 serve to resiliently retain the door portion 15 in the closed position. Of course, the locking arrangement between the door portion 15 and the main body portion 14 may consist of a friction fit between the projection 17*a* and the depression 16*a*. Likewise, a snap-fit engagement may be provided to promote a positive engagement and closure of the door portion.

In additional to the locking system formed by the projections 17*a*, 17*b* and the depressions 16*a*, 16*b*, the present invention may further comprise locking ridges 40, 42 formed on the front end of the attachment flange 22. As shown in FIG. 2, the locking ridges 40, 42 parallely extend away from the access opening 30 on each side of the peg hole 12. Corresponding locking troughs 50, 52 are provided in the door portion 15, and these locking troughs 50, 52 are sized to frictionally engage the locking ridges 40, 42 as shown in FIG. 1. These elements 40, 42, 50, 52 serve to further hold the door portion 15 in the closed position shown in FIG. 1 because the ridges 40, 42 and troughs 50, 52 add stability to resilient characteristic of the entire assembly. For example, the ridges 40, 42 and troughs 50, 52 increase the resilient interface between the projections 17*a*, 17*b* and the depressions 16*a*, 16*b*. In addition, the overall strength of the access opening 30 is enhanced. Moreover, the ridges 40, 42 and troughs 50, 52 add to the frictional resistance holding the door portion 15 in the closed position. Of course, the exact design, size and arrangement of the ridges 40, 42 and troughs 50, 52 may vary from the arrangement shown in FIGS. 1 and 2 without departing from the spirit and scope of the invention.

The main body portion 14 is also formed with a finger-receiving depression 60 positioned on the top surface. The depression 60 makes it easier to open the door portion 15 by permitting the user to pry open the door portion by inserting a finger or finger nail under the flap 24 of the door portion 15.

Figure 3:
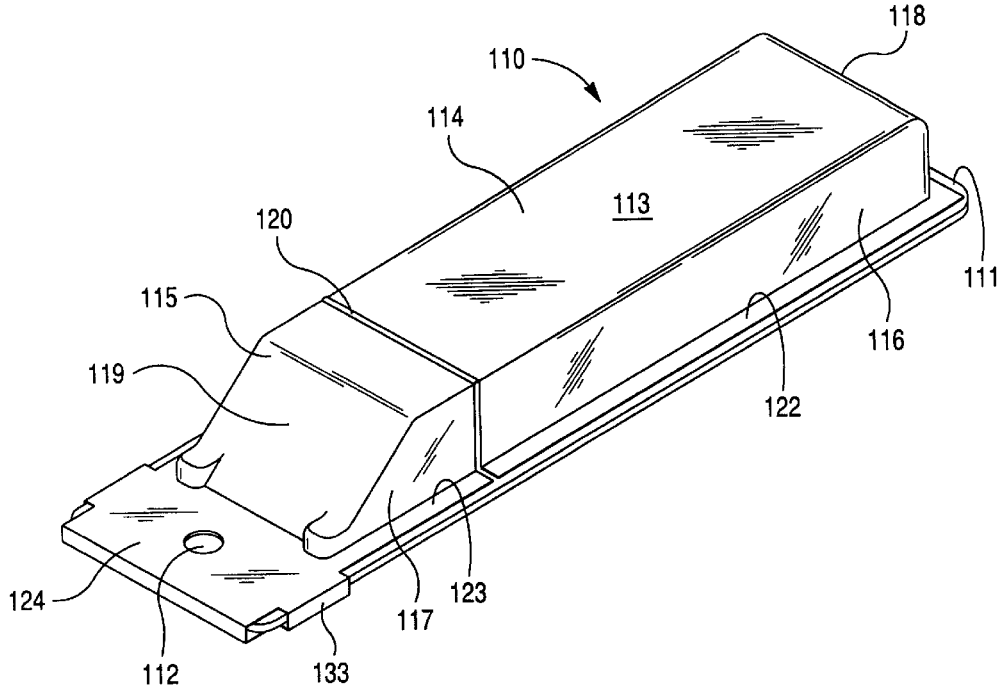
FIG. 3 is a perspective representational view of a tab and slot embodiment of the reclosable blister package assembly shown in a closed position.
Figure 4:
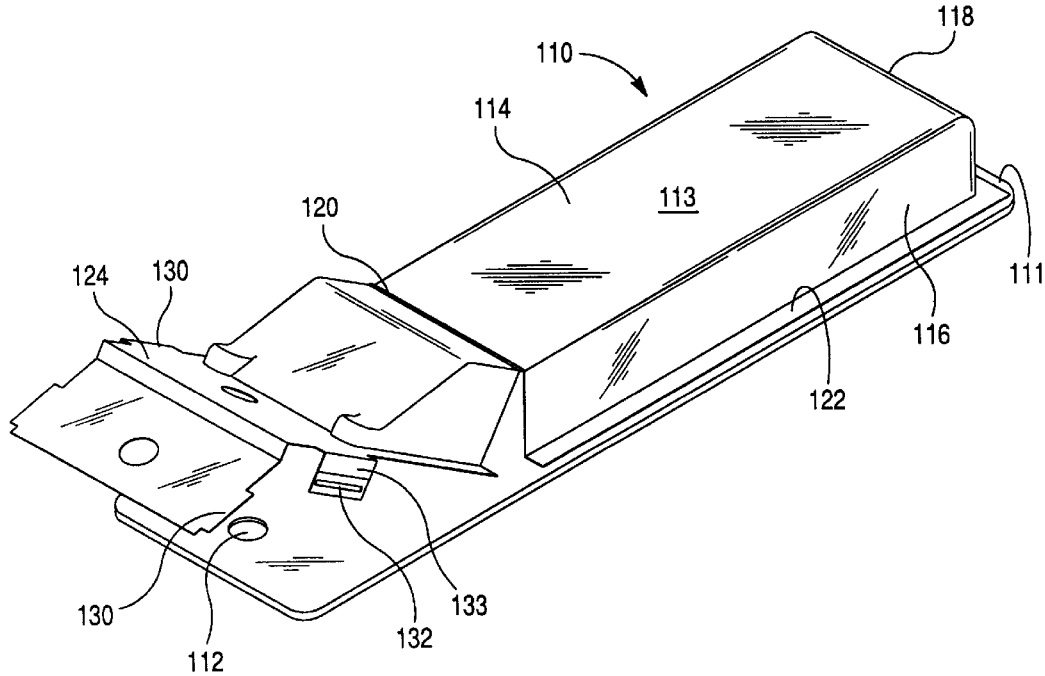
FIG. 4 is a perspective representational view of a tab and slot embodiment of the reclosable blister package assembly of FIG. 3 shown in an opened position.

An alternate embodiment is illustrated in FIGS. 3 and 4. As shown in FIGS. 3 and 4, a plastic blister package assembly 110 is designed to be hung from a peg hook (not shown) inserted through peg hook hole 112 in cardboard planar base plate or substrate 111. A plastic blister assembly 113, formed of unitary construction and preferably of copolyester plastic, typically a glycol modified polyethylene terephthalate, or PVC is provided for attachment to planar base plate 111.

Transverse hinge 120 is integrally formed in the top surface of plastic assembly 113 and serves as a dividing line between a first or lower portion 114*a* of planar top surface 114 and upper, second portion 115*a* of planar top surface 115. Extending from the sides of lower, first portion planar surface 114 are first portion side walls 116 and an interconnecting first portion end wall 118. Circumscribing side walls 116 and end wall 118 is first portion attachment flange 122. Attachment flange 122 is heat sealed to the base plate 111 for permanently attaching plastic assembly 113 to base plate 111. When so attached, a compartment is formed into which merchandise can be inserted.

In like manner, the second, or upper portion 115*a* of planar top surface 115 has extending from its sides, second portion side walls 117 and interconnecting second portion end wall 119. Circumscribing sidewalls 117 and interconnecting end wall 119 is second portion attachment flange 123.

When the upper portion 115*a* of plastic assembly 113 is in the closed position, with second attachment flange 123 positioned against base plate 111, the blister package assembly 110 appears to be of unitary construction having a single compartment all of which is adhesively attached by means of a circumscribing attachment flange to base plate 111.

By providing separate pairs of opposing side walls 116 and 117, and transverse hinge 120, the upper portion of plastic assembly 113 can be folded out away from base plate 111 to provide access to the merchandise compartment defined by the lower portion of plastic assembly 113 and base plate 111, even though base plate 111 is without any hinges as is shown in FIG. 4.

In the second preferred embodiment, the flange 123 is formed with a flange extension 124. As shown in FIGS. 3 and 4, mating portions such as tab portion 130 are formed in flange extension 124 and slots 132 are formed in wings 133. These elements are provided to make the package openable and reclosable without apparent damage. Flange extension 124 wraps around the base plate 111 and a hole 124*a* is provided in the flange extension 124. Wings 133 also wrap around the side edges of the base plate 111. The hole 124*a* is aligned with the hook hole 112 provided in the base plate 111. Tabs 130 slip into slots 132 when the package is closed, and the tabs 130 are frictionally retained in place to provide a positive locking or closing of the package.

Figure 5:
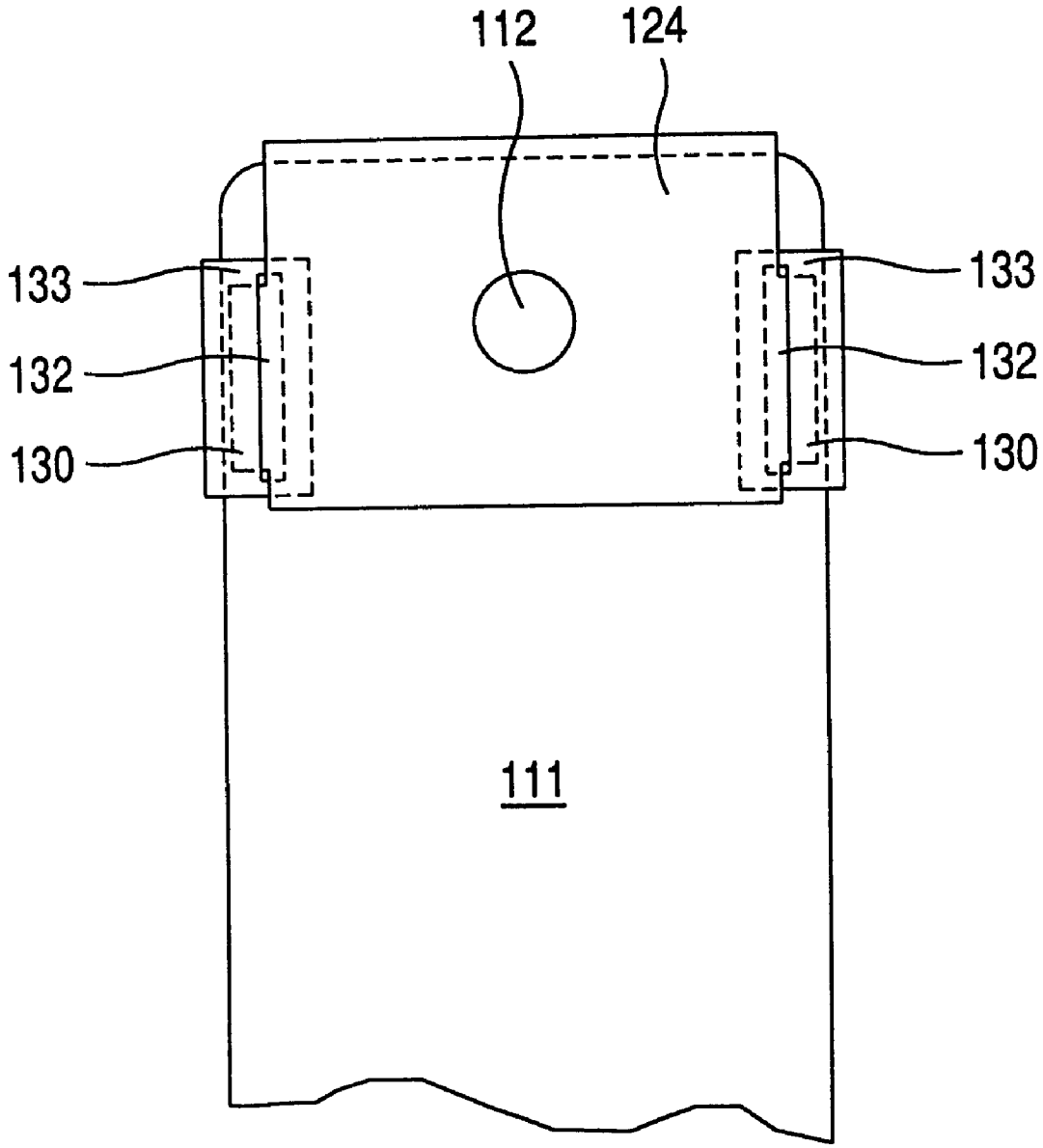
FIG. 5 is a partial rear view of the reclosable tab and slot blister package of FIGS. 3 and 4.

In FIG. 5, the back side of the base plate 111 is partially shown with the tabs 130 positively inserted into the slots 132 provided in the wings 133. The package is opened by manually removing the tabs 130 from the slots 132, and thereafter the extension flange 124 is pulled away from the base plate 111. The upper portion 115*a* is then pivoted away from the base plate about the integral hinge 120 to exposed or provide access to the merchandise compartment defined by the lower portion 114*a* of plastic assembly 113.

Because the inventive package may be opened and reclosed with no apparent damage, some indication of tampering may be provided in the form of tamper evident label. Tamper evident label may, for example, be attached with nonreusable adhesive across a portion of flange 123 and backing 111, so that it must tear or otherwise be destroyed when the package is originally opened. A torn label is therefore evidence of tampering. Tamper evident labels may also be used with the tabs and slots described above.

It is also noted that the upper portion 115*a* may be heat sealed along the secondary attachment flange 123 to the base plate 111 for temporarily attaching the upper portion 115*a* of the plastic assembly 113 to base plate 111. When the package is opened for first time, the heat seal provided along secondary flange 123 is broken, and the upper portion 115*a* may be pivoted away from the base plate 111. When the seal along the secondary flange 123 is broken, it becomes readily evident that someone has tampered with the package.

Figure 6:
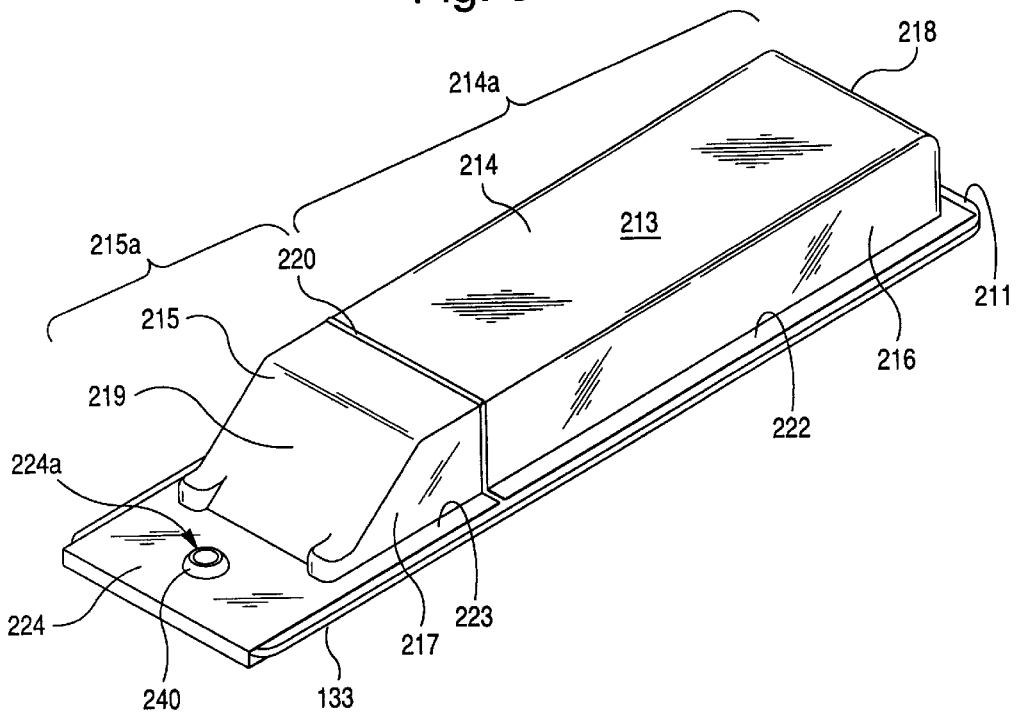
FIG. 6 is a perspective representational view of a button and hole embodiment of the reclosable blister package assembly shown in a closed position.
Figure 7:
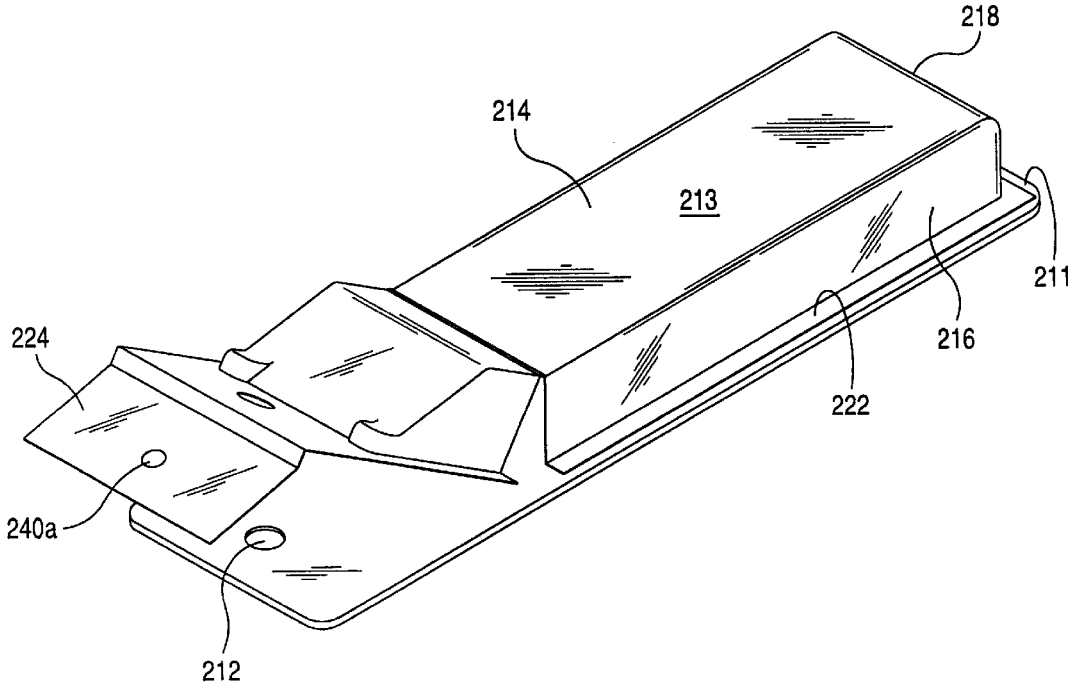
FIG. 7 is a perspective representational view of the button and hole embodiment of the reclosable blister package assembly of FIG. 6 shown in an opened position.
Figure 8:
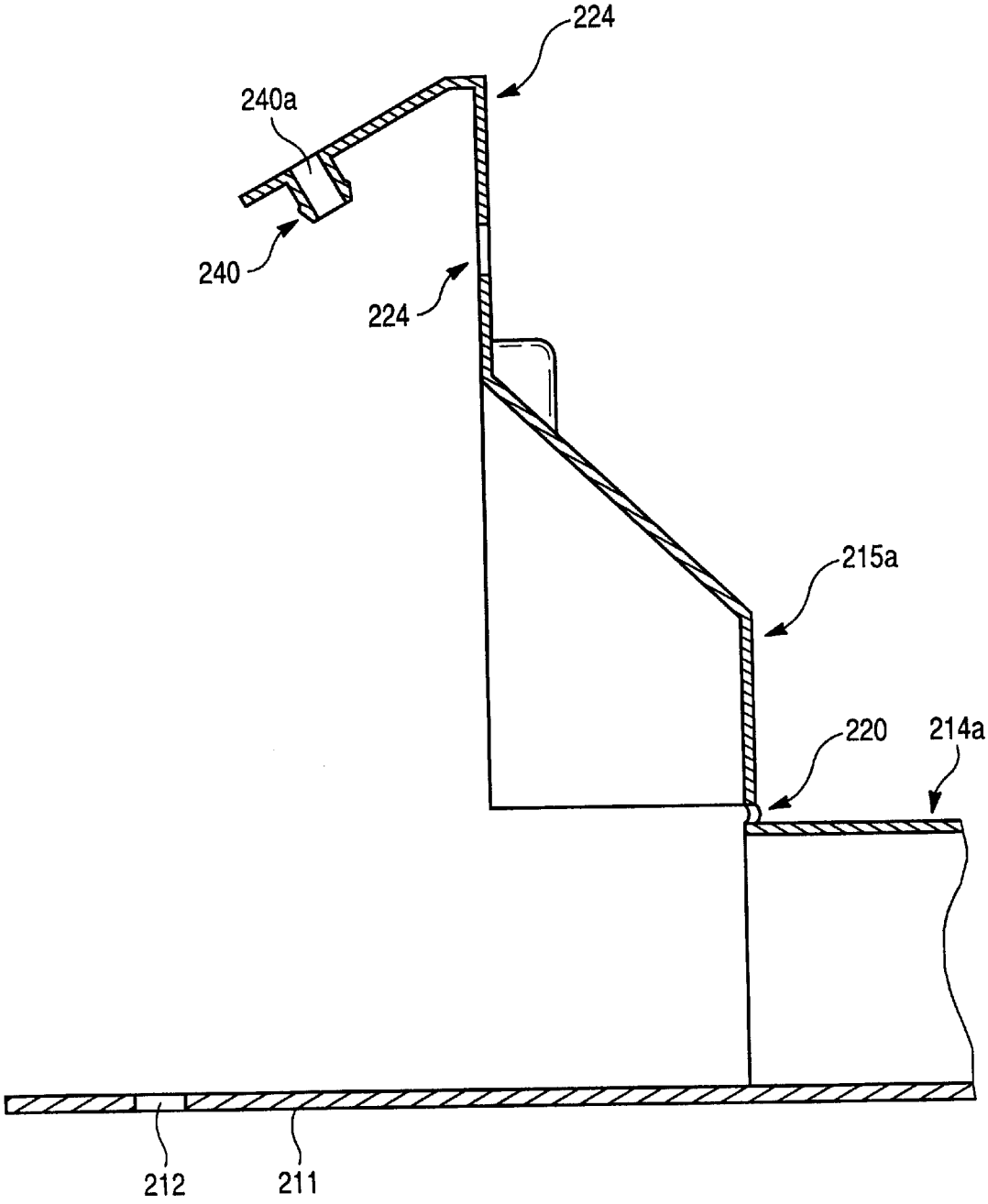
FIG. 8 is a partial cross sectional side view of the reclosable button and hole blister package of FIGS. 6 and 7 shown in the open position.

Another alternate embodiment of the invention is shown in FIGS. 6, 7 and 8. As shown in FIG. 6, a mating portion is provided in the form of a "button" 240 and that engages the "hole" 224*a* and the hook hole 212. Button 240 is formed in the extension flange 224, and the button 240 is sized to mate with the hole 212 formed in the base plate 211 and the hole 224*a* formed in the extension flange 224.

As with the previous embodiment, flange extension 224 wraps around the base plate 211 and a hole 224*a* is provided in the flange extension 224. The hole 224*a* is aligned with the hook hole 212 provided in the base plate 211. The button 240 snaps into both the holes 212 and 224*a* when the package is closed, and the button 240 is frictionally retained in place to provide a positive locking or closing of the package. See FIG. 9.

Button 240 is formed with an aperture 240*a* in order to provide a hanging capability typically served by the hole 212 in the base plate 211. Therefore, the button hole 240*a* is sized to receive the hook or peg typically associated with a hanging display.

Figure 9:
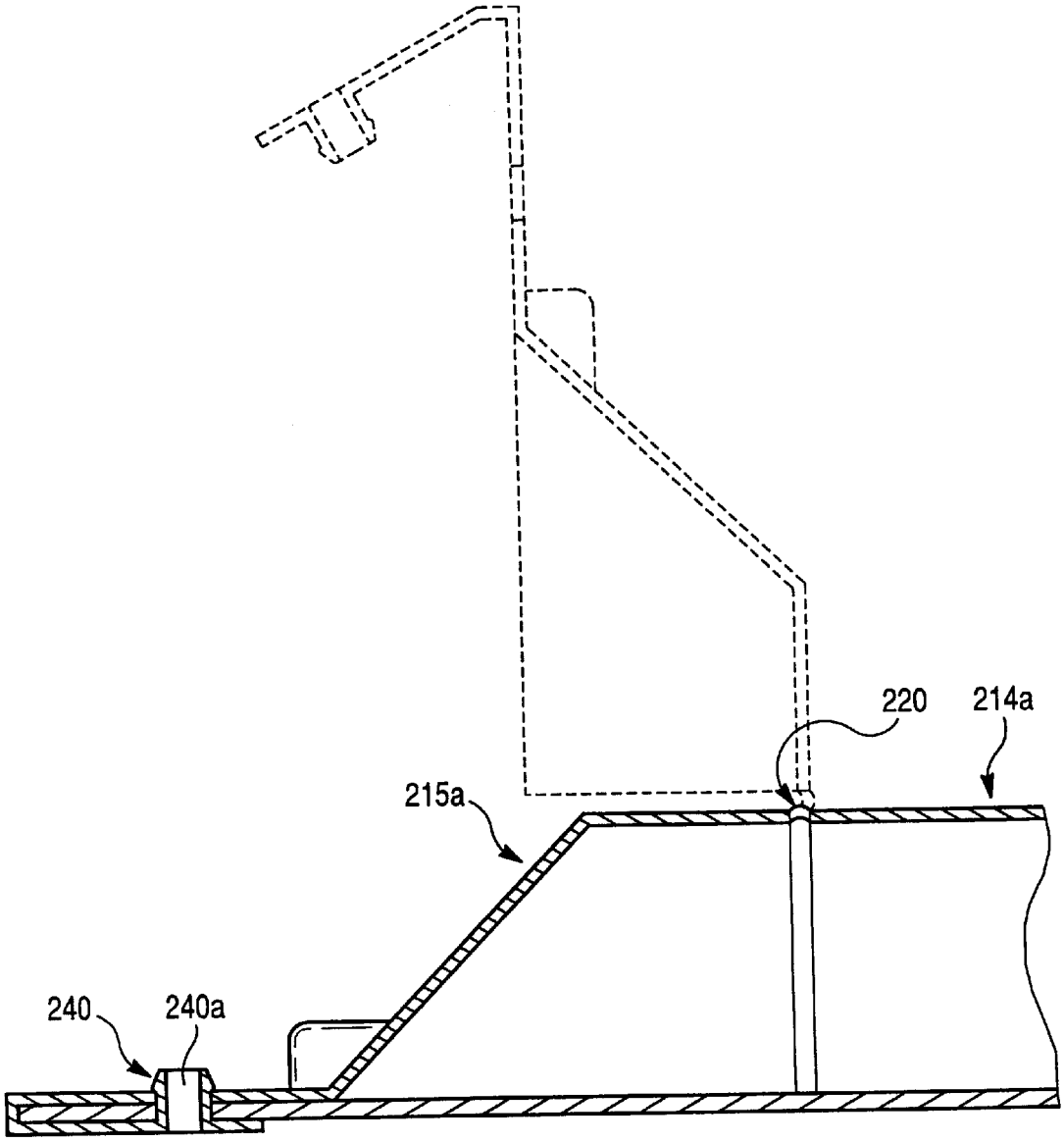
FIG. 9 is a partial cross sectional side view of the reclosable button and hole blister package of FIGS. 6 and 7 shown in the closed position with the open position shown in dotted lines.

To open the package shown in FIGS. 8 and 9, the button 240 is dislodged from the holes 212 and 224*a*, and the flange is pivoted away from the base plate 211 to reveal or provide access to the merchandise compartment defined by the body portion 214*a*. After the user has accessed the merchandise compartment, the second body portion 215*a* closes off the merchandise compartment and the button 240 is again lodged into the holes 212 and 224*a*.

This invention therefore provides a reclosable blister package made from one thermoformed plastic blister that can be easily opened and reclosed without damages to the package, which can be affixed to the backing card in a tamper resistant fashion, and which can be secured to the backing card while fully loaded.

Various modifications may be made to the design illustrated in the attached drawings and described above. For example, the button 240 may be disposed at the location of the hole 224*a* with a hole being provided at the location showing a button in FIGS. 6–9. Likewise, the exact arrangement of the tabs 130 and slot 132 may be altered or modified without departing from the objective of the present invention, i.e. to provide a reclosable blister pack that is relatively easy to manufacture and assembly while maintaining a user friendly package.

While there is shown and described the present preferred embodiment of the invention, it is to be distinctly understood that this invention is not limited thereto but may be variously embodied to practice within the scope of the following claims.

What is claimed is:

1. A reclosable package comprising:

a backing member;

a body member having a first portion attached to a second portion via an integral hinge disposed therebetween;

said first portion comprising side walls and a top face disposed on said backing member to define a merchandise compartment having an open end in one of said side walls;

said second portion comprising side walls and a top wall disposed on said backing member to thereby define a closure for said open end, wherein said second portion pivots between an opened position where said merchandise compartment is exposed at said open end and a closed position where said merchandise compartment is closed by said second portion;

a closure system for securing said second portion in said closed position, said closure system comprising at least one projection and at least one corresponding recess for receiving said at least one projection to define an interlocking friction-fit connection, wherein said backing member and said body member define an extended portion wherein said integral hinge is offset from said open end by a distance sufficient to include closure elements on said extended portion thereby interlocking said first portion to said second portion.

2. The reclosable package of claim 1, wherein said at least one projection is formed in side walls of one of said first and second portions, and said at least one corresponding recess is formed in the other one of said first and second portions.

3. The reclosable package of claim 1, further comprising first and second peg hook apertures passing through said first portion and said second portion, respectively.

4. The reclosable package of claim 1, wherein said first and second peg hook apertures being aligned with each in said closed position.

5. The reclosable package of claim 1, further comprising a finger-receiving depression provided in said top face to facilitate opening of said second portion, said second portion everlying at least a portion of aid depression in said closed position.

6. The reclosable package of claim 1, further comprising said backing member having an edge that terminates along said integral hinge.

7. The reclosable package of claim 1, further comprising closure elements on said extended portion.

8. The reclosable package of claim 1, further comprising a pair of locking ridges formed on one of said first and second portions and a pair of locking troughs formed on the other of said first and second portions, said locking ridges and troughs parallely extending away from said open end.

9. A reclosable package comprising:

a backing member;

a body member having a first portion attached to a second portion via an integral hinge disposed therebetween;

said first portion comprising side walls and a top face disposed on said backing member to define a merchandise compartment having an open end in one of said side walls;

said second portion comprising side walls and a top wall disposed on said backing member to thereby define a closure for said open end, wherein said second portion pivots between an opened position where said merchandise compartment is exposed at said open end and a closed position where said merchandise compartment is closed by said second portion;

a closure system for securing said second portion in said closed position, said closure system comprising at least one projection and at least one corresponding recess for receiving said at least one projection to define an interlocking friction-fit connection; and a pair of locking ridges formed on one of said first and second portions and a pair of locking troughs formed on the other of said first and second portions, said locking ridges and troughs parallely extending away from said open end.

10. The reclosable package of claim 9, further comprising first and second peg hook apertures passing through said first portion and said second portion, respectively.

11. The reclosable package of claim 9, further comprising said first and second peg hook apertures being aligned with each in said closed position.

12. The reclosable package of claim 9, further comprising a finger-receiving depression provided in said top face to facilitate opening of said second portion, said second portion everlying at least a portion of aid depression in said closed position.

13. The reclosable package of claim 9, further comprising said backing member having an edge that terminates along said integral hinge.

* * * * *